US009227116B2

(12) United States Patent
Cynn

(10) Patent No.: US 9,227,116 B2
(45) **Date of Patent: *Jan. 5, 2016**

(54) GOLF PUTTER

(71) Applicant: Kie-Ho Cynn, Kapolei, HI (US)

(72) Inventor: Kie-Ho Cynn, Kapolei, HI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/121,644

(22) Filed: Oct. 1, 2014

(65) Prior Publication Data

US 2015/0080144 A1 Mar. 19, 2015

Related U.S. Application Data

(63) Continuation-in-part of application No. 13/573,490, filed on Sep. 17, 2012, now Pat. No. 8,888,605.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/04* (2013.01); *A63B 2053/0441* (2013.01); *A63B 2053/0491* (2013.01)

(58) Field of Classification Search
CPC ..... A63B 53/04; A63B 53/007; A63B 2053/0491; A63B 2071/0694; A63B 53/0487; A63B 69/3685; A63B 2053/0441
USPC ..... 473/219–256, 340–341, 313–323; D21/736–746, 759
See application file for complete search history.

(56) References Cited

U.S. PATENT DOCUMENTS

| | | | |
|---|---|---|---|
| 1,960,110 | A | 5/1934 | Stanley |
| 3,134,596 | A | 5/1964 | Boznos |
| 3,211,455 | A | 10/1965 | Hyden |
| 3,242,582 | A | 3/1966 | Garrett |
| 3,708,172 | A | 1/1973 | Rango |
| 3,815,910 | A | 6/1974 | Raines |
| 4,114,886 | A | 9/1978 | Koch |
| 4,212,467 | A | 7/1980 | Shiratori |
| 4,317,568 | A | 3/1982 | Green |
| 4,934,702 | A | 6/1990 | Serizawa |
| 4,960,279 | A | 10/1990 | Harris, Jr. |
| 4,962,931 | A | 10/1990 | Jazdzyk, Jr. |
| 5,112,053 | A | 5/1992 | Brucker |
| 5,282,625 | A | 2/1994 | Schmidt et al. |
| 5,342,812 | A | 8/1994 | Niskanen et al. |
| 5,605,510 | A | 2/1997 | Schmidt et al. |
| 5,630,765 | A | 5/1997 | Moore |
| 5,725,441 | A | 3/1998 | Jensen |
| 6,319,146 | B1 | 11/2001 | Mills |
| 6,569,032 | B1 | 5/2003 | Haliyo |

(Continued)

FOREIGN PATENT DOCUMENTS

| | | |
|---|---|---|
| GB | 2335149 | 9/1999 |
| JP | 54-110262 U | 8/1979 |

*Primary Examiner* — Sebastiano Passaniti
(74) *Attorney, Agent, or Firm* — Peter Chin

(57) ABSTRACT

The present invention relates to an improved golf putter head with a unique shape and sighting and alignment system. The head has an annular-like body with an undulating rim edge. A transparent plate extends across the opening of the annular body bearing the alignment aid. The alignment aid may have a crosshair component. The surface of the annular body is provided with a camouflage pattern. The putter shaft additional has a vertical plumb line indicia to aid reading the green.

22 Claims, 7 Drawing Sheets

(56) References Cited

U.S. PATENT DOCUMENTS

| | | | | |
|---|---|---|---|---|
| 6,716,109 | B1 | | 4/2004 | Murtha |
| 7,022,030 | B2 | | 4/2006 | Best et al. |
| 7,351,162 | B2 | | 4/2008 | Soracco et al. |
| 7,377,860 | B2 | | 5/2008 | Breier et al. |
| 7,384,345 | B2 | | 6/2008 | Sherman |
| 7,524,249 | B2 | | 4/2009 | Breier et al. |
| 7,578,752 | B1 | | 8/2009 | Flores |
| 7,588,499 | B2 | | 9/2009 | Tateno |
| 7,645,199 | B2 | | 1/2010 | Cameron |
| 7,658,686 | B2 | | 2/2010 | Soracco |
| 7,857,710 | B2 | | 12/2010 | Pedraza |
| D697,567 | S | * | 1/2014 | Cynn ..... D21/742 |
| D717,895 | S | * | 11/2014 | Cynn ..... D21/757 |
| 8,888,605 | B2 | * | 11/2014 | Cynn ..... A63B 53/04 473/249 |
| 2002/0193184 | A1 | | 12/2002 | Currie et al. |
| 2003/0092503 | A1 | | 5/2003 | Snowdon |
| 2005/0197205 | A1 | | 9/2005 | Hale, Jr. |
| 2006/0063607 | A1 | | 3/2006 | Crossley |
| 2008/0009367 | A1 | | 1/2008 | Johnson |
| 2009/0017934 | A1 | | 1/2009 | Stites et al. |
| 2010/0227704 | A1 | | 9/2010 | Souza et al. |
| 2012/0184393 | A1 | | 7/2012 | Franklin |

* cited by examiner

GOLF PUTTER

CROSS REFERENCE TO RELATED APPLICATIONS

This application is a continuation in part of U.S. patent application Ser. No. 13/573,490, filed Sep. 17, 2012 and herein incorporated by reference.

BACKGROUND OF THE INVENTION

Golf is both a physical and psychological endeavor. Many attempts have been made in designing a putter that minimize visual errors that plague putting by the golfer and improve player confidence in this aspect of golfing. Improved visual and faster acquisition of proper sighting and alignment of the putter have been elusive goals of these attempts.

Visual distraction, which arises from the physical appearance of the putter head, affects the accuracy of the stroke during the act of putting. Efforts to minimize this source of distraction on such factors as shape and/or texture and/or color or color pattern of the top surface of the putter head itself in order to highlight the alignment aid or indicia on the putter head. One solution was proposed in U.S. Pat. No. 4,962,931 (Jazdzyk). This solution involved providing the upper surface of putter head with a camouflaging texture simulating the color and texture of grass covering the putting green. Jazdzyk's camouflaging pattern on the putter head according to Jazdzyk, rendered "the shape of the club head in some degree indistinguishable from the green as observed by a putting golfer and because of the camouflaging effect of the upper surface contrasting and readily observable indicia on the club head is more effective for addressing a golf ball and squaring the putter head with the intended line of putt and stroking of the club head for putting the ball along the intended line on the green." More recent attempts at using color pattern or camouflaging pattern the putter head may be found in the disclosures of GB 2335149A and U.S. Pat. No. 7,022,030.

Accurate reading of the natural lie or break of the green has been a long sought after goal. One such well known method of reading the green is plumb bobbing using the putter or golf club to obtain the true vertical reference or vertical plumb line to determine the natural lie or break has been long practiced and the practice published in numerous articles. It is discussed for example in Green (U.S. Pat. No. 4,317,568), which is hereby incorporated by reference. As is well known practice in plumb bobbing using the putter, the golfer holds the putter at arm's length in front of his or her face with handle or grip of the putter held loosely between his or her fingers and allowing the putter to freely dangle like a pendulum such that the shaft serves as the vertical plumb line. However, due to the shapes of different putter heads and thus, differing center of gravities of the putter heads, true vertical plumb cannot be consistently achieved and accurate reading of the green is thwarted. In order to solve this problem prior attempts to read the natural lie or break of the green by plumb bobbing have involved devices that were internally or externally attached to a putter as exemplified by levels disclosed in Garrett (U.S. Pat. No. 3,242,582) and Murtha (U.S. Pat. No. 6,716,109); by plumb devices attached or inserted into a putter, Brucker (U.S. Pat. No. 5,112,053) and Koch (U.S. Pat. No. 4,114,886); and indicia on or in the putter shaft, Shiratori (U.S. Pat. No. 4,212,467) and Green (U.S. Pat. No. 4,317,568).

BRIEF SUMMARY OF THE INVENTION

The present invention improves and solves the problem of visual distraction caused by the visual appearance of the putter head and allows the golfer to very quickly see only the alignment aid of the putter aid and to help read the green. The present inventive combination of camouflage, transparency and alignment aid design of the putter head and simple plumb line integral with putter shaft for reading the natural lie or break of the green produces synergistic instant visual impact and acquisition, and putter alignment that increases accuracy. Not only the mechanical or physical aspect of putting improved, golfer confidence in his or her putting is also thereby reinforced.

DETAIL DESCRIPTION OF THE INVENTION

Figure 1:
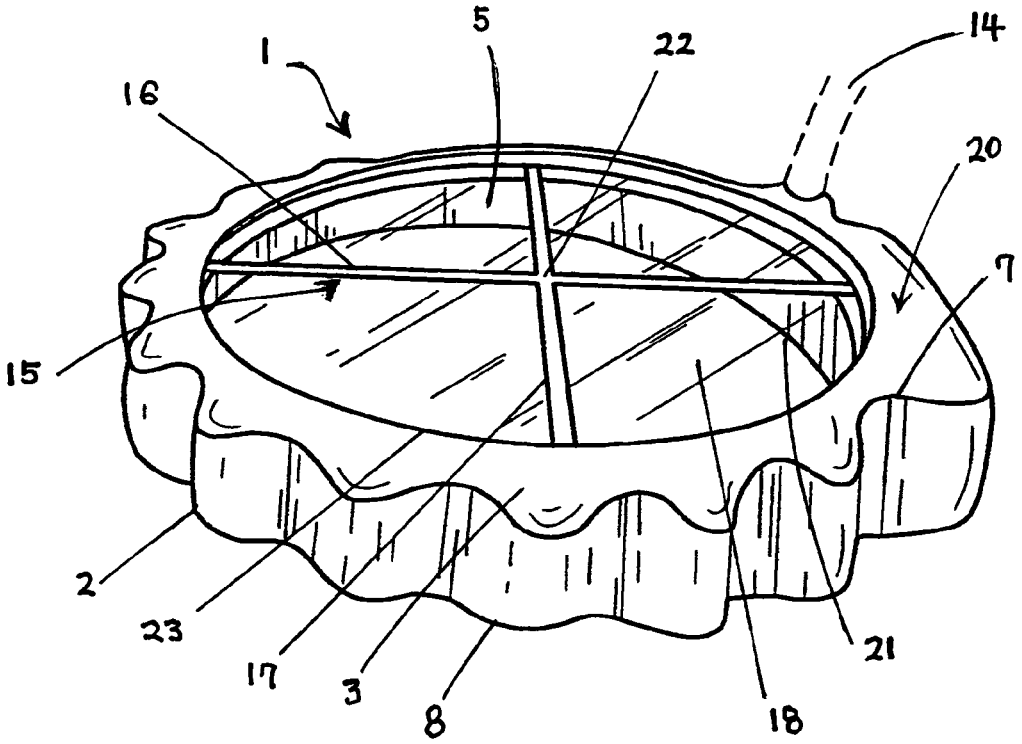
FIG. 1 is a top perspective view of the inventive putter head.
Figure 2:
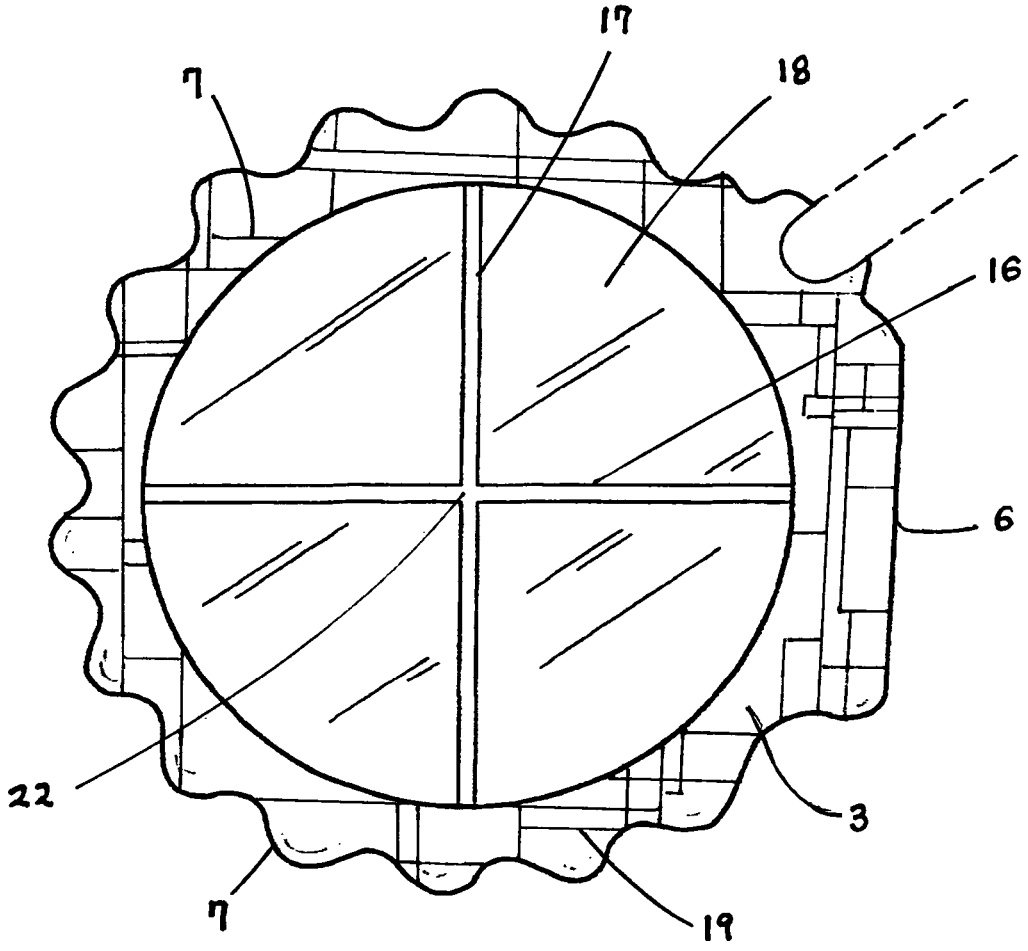
FIG. 2 is a top plan view of the inventive putter head.
Figure 3:
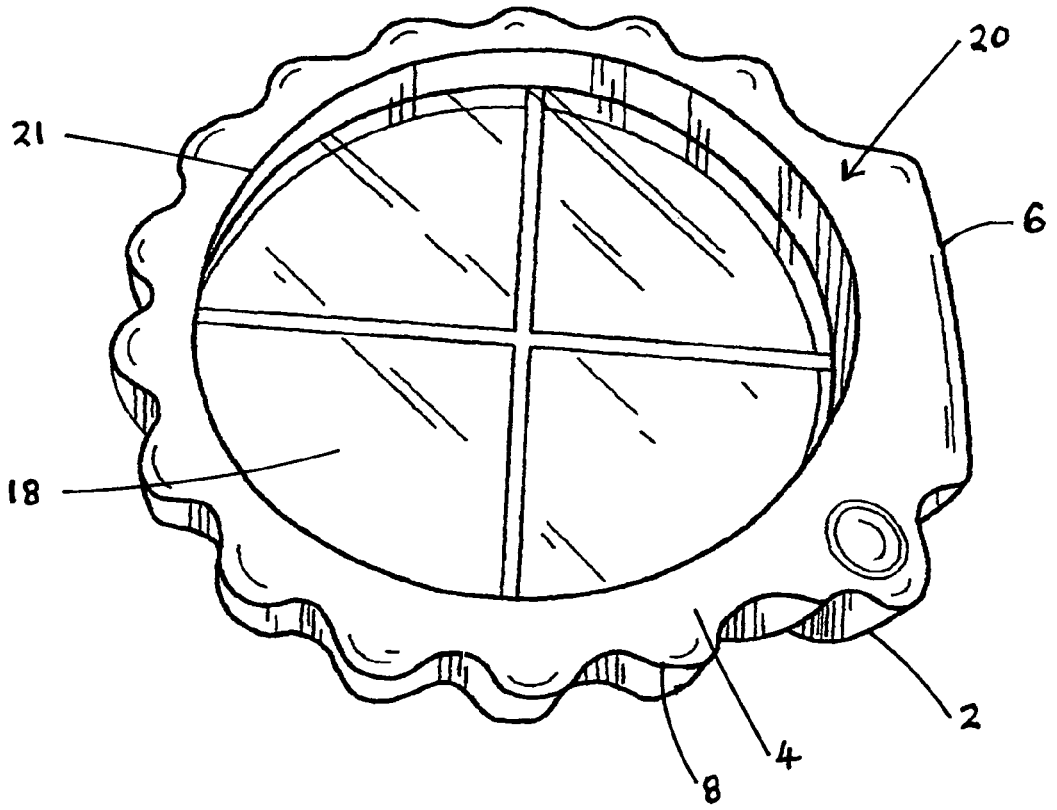
FIG. 3 is a bottom perspective view of the inventive putter head.
Figure 4:
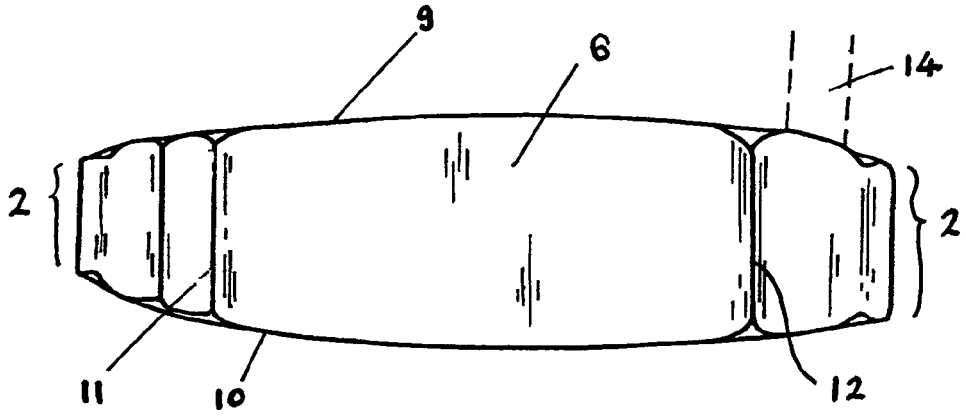
FIG. 4 is a front view of the inventive putter head.
Figure 5:
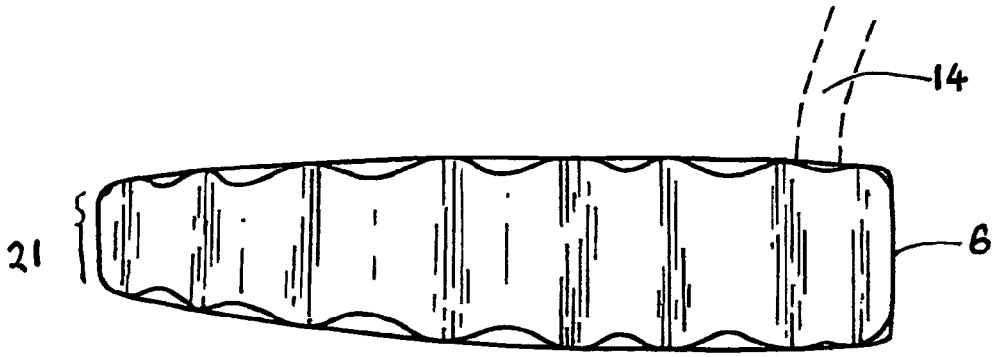
FIG. 5 is a side view of the inventive putter head.
Figure 6:
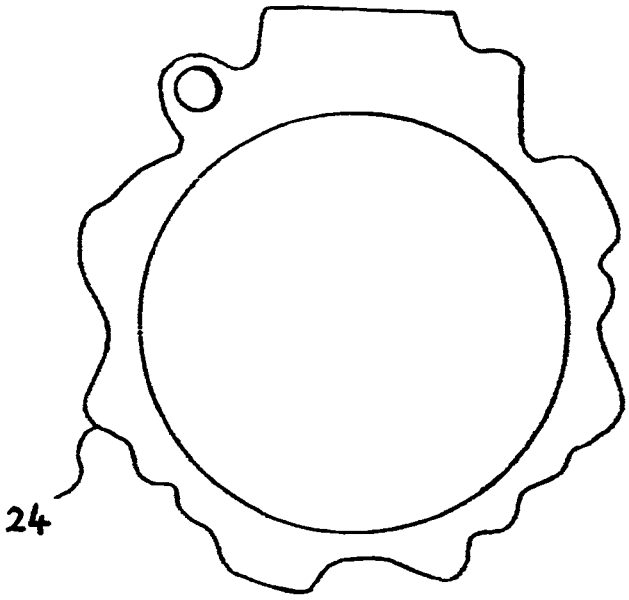
FIG. 6 is a top plan view of an alternative embodiment of the inventive putter head.

The present invention uses shape and color camouflaging pattern of the putter head to hide its shape and blend it into the green and provides a simple means for rapidly assessing and determining the natural lie and break of the green. The configuration of the alignment aid or indicia especially on a transparent background of plate 18 in synergistic combination of camouflaged surface of annular-like body 1 highlights the alignment aid against the green and further amplifies the visual impact of the alignment aid in a manner that the golfer sees only the crosshair and the golf ball. The preferred embodiments of the present invention are presented as follows:

The putter head has annular-like body 1 defined by outer substantially continuous undulating rim edge. In the preferred embodiment shown in the Figures, side rim 2 connecting and extending between outer edge 7 of top annular surface 3 and bottom outer edge 8 of bottom annular surface 4, and substantially cylindrical inner surface 5 between inner edge 23 of top surface 3 and inner edge 21 of bottom annular surface 4. The striking face region 20 at the front of the putter head has a flat or planar striking face 6 having top edge 9, bottom edge 10 and side edges 11 and 12. The undulating side rim 2 of the preferred embodiments shown in the Figures is of a sinusoidal configuration. The embodiment of FIG. 1 through 5 is of a sine wave, one having a relatively regular or constant amplitude and wave length to a point below and proximate to the area of the front striking surface and the area of the club shaft or hosel 14 as seen in FIGS. 2 and 3. Because of the regular sinusoidal appearance, the annular-like body 1 has a rounded teeth-like appearance like that of a toothed gear. The preferred embodiment of the putter head shown in the drawings, the annular-like body has curved top surface and bottom surface. The top surface 3 can be planar and further have a beveled edge. As can be seen from FIGS. 1, 4 and FIG. 5, the top and bottom edge portions of the top and bottom annular surfaces, respectively, can be further beveled from the slightly concave curved top surface 3 and opposed concave curved bottom surface 4. The annular-like body 1 can have a tapered shape or thickness as the curved top surface 3 and curved bottom surface converge from front end 6 and taper toward end 21 as is evident from front view FIG. 4 and side view of FIG. 5. It is noted the term "substantially" as used in the context of the present disclosure and the claims that follow, means small changes or deviations can be present or made without detracting from the overall feature, function and/or appearance of the element of the present invention. Top surface 3 is provided with a colored camouflage pattern 19. The pattern blends or merges the appearance of body 1 with the grass of the green. The putter head is fixed to the hosel or shaft 14 of the putter. In an alternative embodiment, the undulations can be substantially irregular as shown in FIG. 6 which shows an annular-like body that is identical to previously described annular-like body except it has an irregular sinusoidal rim edge configuration 24.

The alignment aid or indicia comprises cross hair 15 of mutually perpendicular lines: aiming line 16 that lies on or in the direction of the putter head's sweet spot and alignment line 17 that is parallel with striking face 6. The cross hair 15 is positioned on transparent plate 18. The cross hair may be simple grooves, lines of highly contrasting color (e.g., pigment or enamel) or defined by other optical effects that accents, strongly contrast and highlight the crosshair against the grass such as line(s) of highly refractive and/or reflective material such as colored or uncolored round, square or any desired shape faceted glass, lead glass or gemstone or other refractive material of sufficiently high refractive index suitable for the purpose. The refractive material can be transparent or translucent.

The undulations of the outer rim 2 of annular-like body 1 softens the profile of the putter head against the grass of the green and together with the camouflage pattern on top surface 3 renders the putter invisible against the grass of the green excepting cross hair 15, which remains highly visible. The top surface camouflage is preferably dull or matte finish. The amplitude and frequency of the undulations of outer rim 2 can optimized to obtain the greatest camouflaging effect and can be adjusted to suit the individual golfer.

The annular-like body 1 can be made of any suitable material: wood, plastic, polymer, metal, ceramic or glass. The body can have recess(es) or cavity to insert weight(s) at the appropriate location(s) to change or adjust the sweet spot and/or Moment of Inertia (MOI) of the putter head if necessary or desired. It is noted that the shape of the recess and thus the weight insert can be any desired shape such as cylindrical or rectangular recess and correspondingly shaped insert. The striking face can have a layer of material that increases the size of the sweet spot such as a polymer, which is laminated or glued onto the surface or into a square or rectangular recess in striking face 6. Polymers are known per se for their effect on putting, see for example U.S. Pat. Nos. 3,211,455 and 6,569,032. It is noted the aforementioned patents do not disclose or suggest the present invention. The area of the strike face can be reduced to a very small area surrounding the sweet spot and still putt with confidence.

The striking face 6 of the putter head can be grooved in any known manner for the purpose of putting.

Transparent plate 18 can allow the golfer to see the grass below to ascertain the condition and texture of the grass but more importantly it amplifies and highlights the crosshair to the exclusion of the visual appearance of the rest of the putter head. In the embodiment shown in Figures, the crosshair is centered at point 22 in the middle or center of circular transparent plate 18 that extends across the open annular region of the annular-like body 1. The plate may be of any desired thickness as long as it does not protrude from the bottom of the putter head and of any suitable transparent material such as plastic or glass.

To obtain a reading of the green prior to putting, the inventive putter is used as a plumb bob, which provides a vertical reference to help judge the natural lie or break of the green. To enable quick and accurate plumb bobbing of the green using the putter, a plumb line indicia or marking is provided on the shaft of the putter. The plumb line indicia corresponds to and marks the vertical plumb line of the putter, the determination of which is well known and as an example disclosed by Green (U.S. Pat. No. 4,317,568), which is herein incorporated by reference. The plumb line indicia enables the putter shaft to be quickly, accurately and consistently used as a vertical plumb line to aid in determining the natural lie or break in the green.

Figure 7:
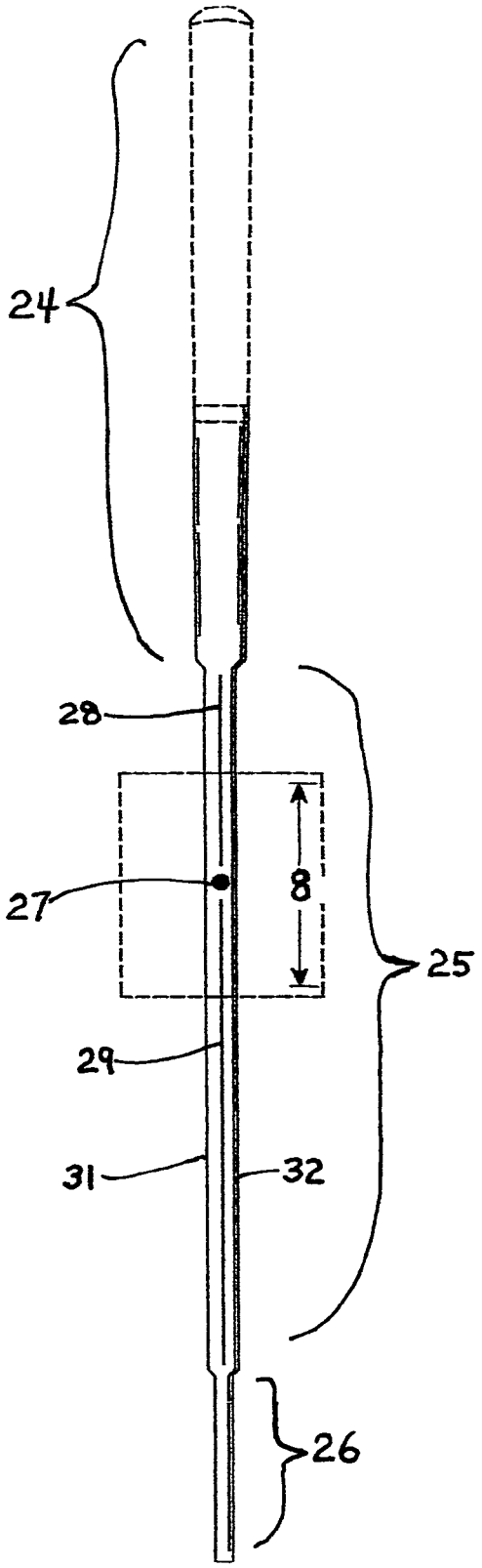
FIG. 7 is a perspective view of the inventive plumb line indicia on the putter shaft.
Figure 8:
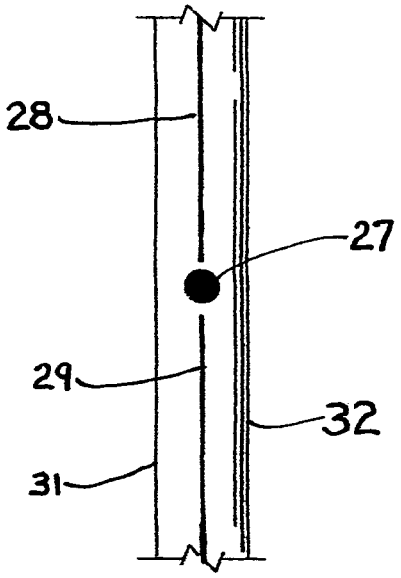
FIG. 8 is an enlarged/close up view of the inventive plumb line indicia shown in FIG. 7.
Figure 11:
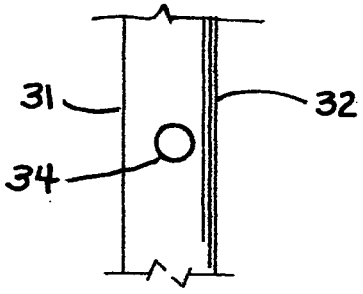
FIG. 11 is an enlarged view of yet another embodiment of the inventive plumb line indicia.

FIG. 7 shows one preferred embodiment of the inventive vertical plumb line indicia on the putter having handle portion 24, vertical plumb indicia bearing portion 25, and optionally end shaft portion 26. The vertical plumb line indicia is contained within portion 25 and composed of three elements, an upper vertical line 28 terminating above circle 27 and lower vertical line 29 below circle 27. The viewed apparent peripheral edge of putter portion 25 is denoted at 31 and 32. An enlarged view of the indicia on the portion 25 is shown in FIG. 8. It is noted that while circle 27 is shown as solid or circular dot, it can be a simple line circle as shown in the embodiment of FIG. 11. The solid dot and indeed any of the indicia or markings used in the present invention can be of any suitable color, luster or texture for the purpose and not limited to black.

Figure 9:
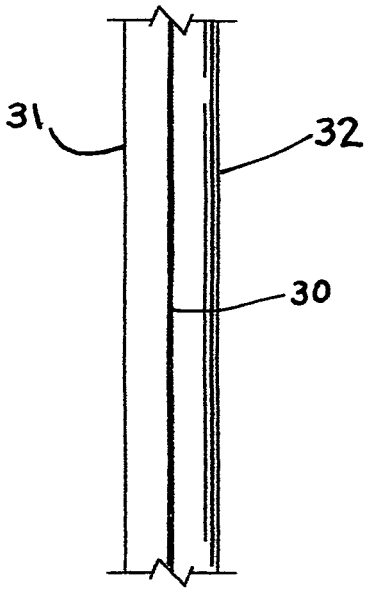
FIG. 9 is an enlarged view of another embodiment of the inventive plumb line indicia.

FIG. 9 shows a preferred embodiment wherein the vertical plumb line indicia is a single line.

Figure 10:
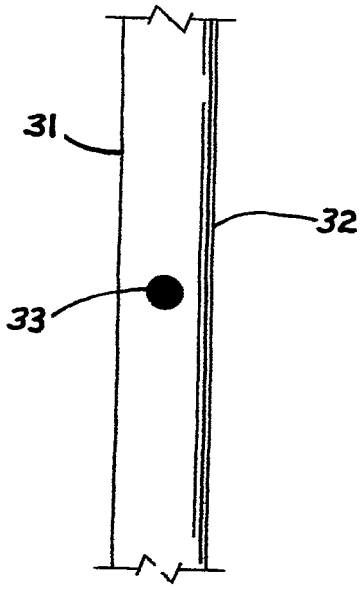
FIG. 10 is an enlarged view of still another embodiment of the inventive plumb line indicia.

FIG. 10 shows a preferred embodiment wherein the vertical plumb line indicia is a single circular dot.

FIG. 11 shows a preferred embodiment wherein the vertical plumb line indicia is a single simple line circle.

Shaft portion 25 bearing vertical plumb line indicia is preferably of constant width or diameter or cylindrical shape. This enhances accuracy of aligning the plumb line indicia and the shaft for plumb bobbing. The golfer holds out the putter for plumb bobbing, views and adjusts the position of the putter such that the vertical plumb line indicia is centered between the two parallel peripheral edges 31 and 32 of the putter, which increases accuracy of positioning the putter for plumb bobbing. The length of this shaft portion is at the least coextensive with the vertical dimension of the indicia or marking.

It is understood that modifications and variations of the above disclosed preferred embodiments within the purview of one skilled in art are within scope of the invention.

The invention claimed is:

1. A golf putter comprising a golf putter head and a shaft attached there to, said golf putter head comprising an annular body, said annular body defined by a substantially continuous annular undulating outer rim extending outwardly between an outer edge of a top annular surface and an outer edge of a bottom annular surface, said undulating rim extending continuously around the annular body terminating proximately at a striking face on a front of said annular body; an annular opening defined by an inner substantially continuous surface extending substantially vertically from an inward edge of the top surface to an inward edge of the bottom annular surface; a clear transparent plate having an alignment aid comprising means for defining a crosshair; said shaft having a shaft portion containing a plumb line indicia or marking for enabling said putter for use as a vertical plumb bob.

2. The golf putter of claim 1, wherein said clear transparent plate of said golf putter head is circular.

3. The golf putter of claim 1, wherein said top surface of said golf putter head is provided with a camouflage pattern.

4. The golf putter of claim 1, wherein said undulating rim of said golf putter head comprises a sinusoidal rim.

5. The golf putter of claim 3, wherein said undulating rim of said golf putter head comprises a regular sinusoidal rim.

6. The golf putter of claim 1, wherein said undulating rim of said golf putter head comprises an irregular sinusoidal rim.

7. The golf putter of claim 1, wherein said means for defining a crosshair of said golf putter head comprises an intersecting pair of grooves.

8. The golf putter of claim 1, wherein said means for defining a crosshair of said golf putter head comprises intersecting lines of highly contrasting color.

9. The golf putter of claim 1, wherein said means for defining crosshair of said golf putter head comprises intersecting lines of high refractive or reflective material.

10. The golf putter of claim 9, wherein said high refractive material is selected from the group consisting of glass, lead glass, gemstones and mixtures thereof.

11. The golf putter of claim 1, wherein said bottom annular surface of said golf putter head is curved.

12. The golf putter of claim 1, wherein said top annular surface of said golf putter head is curved.

13. The golf putter of claim 1, wherein said top annular surface of said golf putter head extends from said striking face and curves downward from an area toward said bottom annular surface, said bottom annular surface curves upwardly toward said top annular surface and convergingly toward a distal end of said golf putter head away from and opposite to said striking face.

14. The golf putter of claim 1, wherein said outer edge of bottom annular surface of said golf putter head is beveled.

15. The golf putter of claim 1, wherein said outer edge of top surface of said golf putter head is beveled.

16. The golf putter of claim 1, wherein said clear transparent plate of said golf putter head has a center point, said crosshair has an intersecting point and said intersecting point is positioned substantially in the center point of said clear transparent plate.

17. The golf putter of claim 1, wherein said plumb line indicia or marking comprises an upper vertical line terminating above a solid colored dot or circle and lower vertical line beginning and extending below said solid dot or circle.

18. The golf putter of claim 1, wherein said plumb line indicia or marking comprises a single solid line.

19. The golf putter of claim 1, wherein said plumb line indicia or marking comprises a solid black or colored dot.

20. The golf putter of claim 1, wherein said plumb line indicia or marking comprises a line circle.

21. The golf putter of claim 1, wherein said shaft portion containing said plumb line indicia or marking comprises a constant diameter or width.

22. A golf putter comprising a golf putter head and a shaft attached there to, said golf putter head comprising an annular body, said annular body defined by a substantially continuous annular undulating outer rim extending outwardly between a top annular surface and a bottom annular surface, said top annular surface provided with a camouflage pattern, said undulating rim extending continuously around the annular body terminating proximately at a striking face on said annular body; an annular opening defined by an inner substantially continuous surface extending substantially vertically from an inward edge of the top surface to an inward edge of the bottom annular surface; a substantially circular clear transparent plate having an alignment aid comprising means for defining a crosshair; said shaft having a shaft portion containing plumb line indicia or marking for enabling said putter for use as a vertical plumb bob.

* * * * *